US009533395B2

(12) United States Patent
Tanikawa et al.

(10) Patent No.: US 9,533,395 B2
(45) Date of Patent: Jan. 3, 2017

(54) METHOD AND APPARATUS FOR CONDITIONING A POLISHING PAD

(71) Applicant: EBARA CORPORATION, Tokyo (JP)

(72) Inventors: Mutsumi Tanikawa, Tokyo (JP); Takahiro Shimano, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 15/041,284

(22) Filed: Feb. 11, 2016

(65) Prior Publication Data

US 2016/0158911 A1 Jun. 9, 2016

Related U.S. Application Data

(62) Division of application No. 13/488,774, filed on Jun. 5, 2012, now Pat. No. 9,469,013.

(30) Foreign Application Priority Data

Jun. 8, 2011 (JP) ..... 2011-128330

(51) Int. Cl.

| | |
|---|---|
| ***B24B 49/00*** | (2012.01) |
| ***B24B 53/017*** | (2012.01) |
| ***B24B 49/18*** | (2006.01) |
| ***B24B 53/02*** | (2012.01) |

(52) U.S. Cl.

CPC ..... *B24B 53/017* (2013.01); *B24B 49/006* (2013.01); *B24B 49/18* (2013.01); *B24B 53/02* (2013.01)

(58) Field of Classification Search

CPC .... B24B 53/005; B24B 53/013; B24B 53/017; B24B 53/02; B24B 53/12; B24B 49/18; B24B 49/006

See application file for complete search history.

(56) References Cited

U.S. PATENT DOCUMENTS

| | | | | |
|---|---|---|---|---|
| 5,216,843 | A | 6/1993 | Breivogel et al. | |
| 5,547,417 | A | 8/1996 | Breivogel et al. | |
| 5,876,271 | A * | 3/1999 | Oliver | B24B 37/105 451/41 |
| 6,896,583 | B2 | 5/2005 | Rodriquez et al. | |

(Continued)

FOREIGN PATENT DOCUMENTS

| | | |
|---|---|---|
| JP | 2000-761 | 1/2000 |
| JP | 2002-200552 | 7/2002 |

(Continued)

OTHER PUBLICATIONS

Extended European Search Report issued Jul. 17, 2014 in corresponding European Patent Application No. 12004310.4.

*Primary Examiner* — Timothy V Eley
(74) *Attorney, Agent, or Firm* — Wenderoth, Lind & Ponack, L.L.P.

(57) ABSTRACT

A method of conditioning a surface of a polishing pad is used for conditioning a polishing pad on a polishing table for polishing a thin film formed on a surface of a substrate. The conditioning method includes bringing a dresser into contact with the polishing pad, and conditioning the polishing pad by moving the dresser between a central part of the polishing pad and an outer circumferential part of the polishing pad. A moving speed of the dresser at a predetermined area of the polishing pad is higher than a standard moving speed of the dresser at the predetermined area of the polishing pad.

12 Claims, 4 Drawing Sheets

(56) References Cited

U.S. PATENT DOCUMENTS

| | | | |
|---|---|---|---|
| 6,905,397 | B2 | 6/2005 | Sharan |
| 7,011,566 | B2 | 3/2006 | Chandrasekaran |
| 7,837,534 | B2 | 11/2010 | Aiyoshizawa et al. |
| 2001/0006874 | A1 | 7/2001 | Moore |
| 2002/0164932 | A1 | 11/2002 | Kamimura et al. |
| 2002/0197745 | A1 | 12/2002 | Shanmugasundram et al. |
| 2004/0192168 | A1 | 9/2004 | Faustmann et al. |
| 2006/0003670 | A1 | 1/2006 | Golzarian |
| 2007/0049168 | A1 | 3/2007 | Fujita |
| 2009/0137190 | A1 | 5/2009 | Togawa et al. |
| 2010/0035525 | A1 | 2/2010 | Deshpande |
| 2010/0081361 | A1 | 4/2010 | Fukuda et al. |
| 2010/0227435 | A1 | 9/2010 | Park et al. |
| 2011/0070745 | A1 | 3/2011 | Matsui et al. |

FOREIGN PATENT DOCUMENTS

| | | |
|---|---|---|
| JP | 2005-125444 | 5/2005 |
| JP | 2008-284645 | 11/2008 |
| JP | 2009-291942 | 12/2009 |
| JP | 2010-76049 | 4/2010 |
| TW | 200613092 | 5/2006 |
| TW | 200800491 | 1/2008 |
| WO | 2006/022452 | 3/2006 |

* cited by examiner

METHOD AND APPARATUS FOR CONDITIONING A POLISHING PAD

CROSS REFERENCE TO RELATED APPLICATIONS

This document claims priority to Japanese Application Number 2011-128330, filed Jun. 8, 2011, the entire contents of which are hereby incorporated by reference.

BACKGROUND OF THE INVENTION

Field of the Invention

The present invention relates to a conditioning method and apparatus of a polishing pad, and more particularly to a method and apparatus for conditioning a surface of a polishing pad used for polishing a substrate such as a semiconductor wafer.

Description of the Related Art

In recent years, high integration and high density in semiconductor device demands smaller and smaller wiring patterns or interconnections and also more and more interconnection layers. Multilayer interconnections in smaller circuits result in greater steps which reflect surface irregularities on lower interconnection layers. An increase in the number of interconnection layers makes film coating performance (step coverage) poor over stepped configurations of thin films. Therefore, better multilayer interconnections need to have the improved step coverage and proper surface planarization. Further, since the depth of focus of a photolithographic optical system is smaller with miniaturization of a photolithographic process, a surface of the semiconductor device needs to be planarized such that irregular steps on the surface of the semiconductor device will fall within the depth of focus.

Thus, in a manufacturing process of a semiconductor device, it increasingly becomes important to planarize a surface of the semiconductor device. One of the most important planarizing technologies is chemical mechanical polishing (CMP). Thus, there has been employed a chemical mechanical polishing apparatus for planarizing a surface of a semiconductor wafer. In the chemical mechanical polishing apparatus, while a polishing liquid containing abrasive particles such as ceria ($CeO_2$) therein is supplied onto a polishing pad, a substrate such as a semiconductor wafer is brought into sliding contact with the polishing pad, so that the substrate is polished.

A polishing apparatus for performing the above CMP process includes a polishing table having a polishing pad, and a substrate holding device, which is referred to as a top ring or a polishing head, for holding a substrate such as a semiconductor wafer. By using such a polishing apparatus, the substrate is held and pressed against the polishing pad under a predetermined pressure by the substrate holding device, thereby polishing an insulating film or a metal film on the substrate.

After one or more substrates have been polished, abrasive particles in a polishing liquid or ground-off particles of the substrate are attached to the surface of the polishing pad, resulting in a change in properties of the polishing pad and deterioration in polishing performance. Therefore, as the substrates are repeatedly polished by the same polishing pad, a polishing rate is lowered and nonuniform polishing action is caused. Thus, conditioning (also referred to as dressing) of the polishing pad is performed to regenerate the surface of the polishing pad which has deteriorated.

A conditioning apparatus (dressing apparatus) for performing conditioning (dressing) of the polishing pad generally has a swingable arm and a dresser fixed to a forward end of the arm as disclosed in Japanese laid-open patent publication No. 2002-200552. In a conditioning process performed by the conditioning apparatus, while the dresser is oscillated radially of the polishing pad by the arm and is rotated about its axis, the dresser is pressed against the polishing pad on the rotating polishing table to remove the abrasive particles and the ground-off particles attached to the polishing pad and to flatten and dress the polishing pad. In general, the dresser having a surface (dressing surface), being brought into contact with the pad surface, on which diamond particles are electro deposited is used.

In the conventional conditioning apparatus (dressing apparatus), in the case where the dresser is oscillated radially of the polishing pad, in order to maximize the life of the polishing pad, the oscillating speed of the dresser is adjusted so that the entire pad surface is uniformly dressed and the polishing pad is worn down flat.

The present inventors have repeatedly conducted experiments of polishing substrates by using the polishing pads which have been conditioned (dressed) by the dresser whose oscillating speed has been adjusted to enable each of the polishing pads to be worn down flat. As a result, the present inventors have learned that a supply amount of a polishing liquid (slurry) to a central part of the substrate becomes scarce due to the relationship between a polishing pressure, respective rotating speeds of the polishing table and the top ring, and the shape of grooves or holes in the surface of the polishing pad, and thus uniform polishing rate cannot be obtained over the entire surface of the substrate.

In particular, in the ceria CMP process in which the polishing pad, called a perforated pad, having a number of small holes in the surface of the polishing pad is used and the substrate is polished while a polishing liquid containing ceria ($CeO_2$) as abrasive particles is supplied to the polishing pad, in the case of high-pressure polishing for polishing the substrate by pressing the substrate against the polishing pad at a high-pressure of 400 hPa or higher, it is difficult for the polishing liquid (slurry) to enter the central part of the surface, being polished, of the substrate. Therefore, an amount of the polishing liquid (slurry) becomes scarce to lower the polishing rate at the central part of the surface, being polished, of the substrate, resulting in nonuniform polishing rate in the entire substrate.

Further, as in the case where an insulating film or a metal film having a relatively large thickness on the substrate is removed, when prolonged polishing is required, the polishing performance of the ceria abrasive particles is lowered due to temperature rise of the surface of the polishing pad, and supply capacity of the polishing liquid (slurry) is lowered with time due to a change in surface state of the polishing pad.

SUMMARY OF THE INVENTION

The present invention has been made in view of the above circumstances. It is therefore an object of the present invention to provide a conditioning method and apparatus of a polishing pad which can prevent a polishing rate in a central part of a surface, being polished, of a substrate such as a semiconductor wafer from lowering, and can planarize the surface, being polished, of the substrate uniformly over the entire surface of the substrate.

In order to achieve the above object, according to a first aspect of the present invention, there is provided a method of conditioning a polishing pad on a polishing table for polishing a thin film formed on a surface of a substrate by being brought into contact with the thin film, comprising: bringing a dresser into contact with the polishing pad; and conditioning the polishing pad by moving the dresser between a central part of the polishing pad and an outer circumferential part of the polishing pad; wherein a moving speed of the dresser at a predetermined area of the polishing pad is higher than a standard moving speed of the dresser at the predetermined area of the polishing.

In a preferred aspect of the present invention, the standard moving speed of the dresser is such a moving speed as to wear down an entire surface of the polishing pad uniformly.

According to the present invention, there is provided a method of conditioning a polishing pad on a polishing table for polishing a thin film formed on a surface of a substrate by being brought into contact with the thin film, comprising: bringing a dresser into contact with the polishing pad; and conditioning the polishing pad by moving the dresser between a central part of the polishing pad and an outer circumferential part of the polishing pad. A moving speed of the dresser at a predetermined area of the polishing pad is higher than a moving speed of the dresser at the predetermined area of the polishing pad in a standard moving recipe to increase a polishing rate of the thin film on the substrate which is polished by being brought into contact with the predetermined area of the polishing pad.

According to the present invention, by making a moving speed of the dresser for dressing a polishing pad at a predetermined area of the polishing pad higher than a moving speed of the dresser at the predetermined area of the polishing pad in a standard moving recipe to condition the polishing pad, the pad scratching distance by the dresser is small in the predetermined area where the moving speed of the dresser is high, and the pad scratching distance by the dresser is large in other areas where the moving speed of the dresser is low. Thus, the amount of slurry remaining in the predetermined area on the polishing pad becomes large, and the amount of slurry remaining in the other areas of the polishing pad becomes small. Therefore, the polishing rate of the thin film on the substrate which is brought into sliding contact with the predetermined area where the amount of residual slurry is large on the polishing pad and is polished can be enhanced. Conventionally, because the moving speed of the dresser has been a moving speed adjusted to wear down the entire surface of the polishing pad uniformly, a certain area on the substrate (e.g., the central area of the substrate) has been polished insufficiently. However, according to the present invention, the polishing rate is prevented from lowering in such an area on the substrate to improve in-plane uniformity of the polishing rate over the entire surface of the substrate. The pad scraping distance is defined as a travel distance in which abrasive particles on the surface of the dresser travel on the surface of the polishing pad within a predetermined time while the dresser is brought into contact with the surface of the polishing pad.

The standard moving recipe does not mean that the moving speed of the dresser is uniform over all of the areas on the polishing pad. Because the dresser has a limitation in operation range, the dresser needs turn-back operation, and the dresser body has a certain size, even if the dresser is moved at a uniform speed over all of the areas on the polishing pad, the polishing pad is not worn down uniformly. The standard moving recipe is experimentally produced by performing experiments on the basis of simulation which takes into account the above points and by repeating feedback of the experimental results. Here, making the moving speed of the dresser high or making the moving speed of the dresser low means that the moving speed of the dresser is made higher or lower than that in the identical area in the standard moving recipe.

According to a second aspect of the present invention, there is provided a method of conditioning a polishing pad on a polishing table for polishing a thin film formed on a surface of a substrate by being brought into contact with the thin film, comprising: bringing a dresser into contact with the polishing pad; and conditioning the polishing pad by moving the dresser between a central part of the polishing pad and an outer circumferential part of the polishing pad. A moving speed of the dresser at a predetermined area of the polishing pad is lower than a standard moving speed of the dresser at the predetermined area of the polishing pad.

In a preferred aspect of the present invention, the standard moving speed of the dresser is such a moving speed as to wear down an entire surface of the polishing pad uniformly.

According to the present invention, there is provided a method of conditioning a polishing pad on a polishing table for polishing a thin film formed on a surface of a substrate by being brought into contact with the thin film, comprising: bringing a dresser into contact with the polishing pad; and conditioning the polishing pad by moving the dresser between a central part of the polishing pad and an outer circumferential part of the polishing pad. A moving speed of the dresser at a predetermined area of the polishing pad is lower than a moving speed of the dresser at the predetermined area of the polishing pad in a standard moving recipe to decrease a polishing rate of the thin film on the substrate which is polished by being brought into contact with the predetermined area of the polishing pad.

According to the present invention, by making a moving speed of the dresser for dressing a polishing pad at a predetermined area of the polishing pad lower than a moving speed of the dresser at the predetermined area of the polishing pad in a standard moving recipe to condition the polishing pad, the pad scratching distance by the dresser is large in the predetermined area where the moving speed of the dresser is low, and the pad scratching distance by the dresser is small in other areas where the moving speed of the dresser is high. Thus, the amount of slurry remaining in the predetermined area on the polishing pad becomes small, and the amount of slurry remaining in the other areas of the polishing pad becomes large. Therefore, the polishing rate of the thin film on the substrate which is brought into sliding contact with the predetermined area where the amount of residual slurry is small on the polishing pad and is polished can be lowered. Conventionally, because the moving speed of the dresser has been a moving speed adjusted to wear down the entire surface of the polishing pad uniformly, a certain area on the substrate (e.g., the outer circumferential area of the substrate) has been excessively polished. However, according to the present invention, the polishing rate can be lowered in such an area on the substrate to improve in-plane uniformity of the polishing rate over the entire surface of the substrate.

In a preferred aspect of the present invention, the moving speed of the dresser is an oscillating speed of the dresser which is oscillated about a swing shaft located outside the polishing table. The moving speed of the dresser includes a moving speed of the dresser in the case where the dresser is moved linearly in a radial direction or a substantially radial direction of the polishing pad as well as the oscillating speed of the dresser where the dresser is oscillated (swung).

In a preferred aspect of the present invention, the polishing pad comprises a polishing pad having a number of holes in a surface thereof.

According to the present invention, in the case where the polishing pad comprises a perforated pad having a large number of fine holes formed in a surface thereof, the amount of residual slurry tends to be larger in the predetermined area where the oscillating speed of the dresser is high than the amount in the other areas where the oscillating speed of the dresser is low.

In a preferred aspect of the present invention, a polishing liquid containing ceria particles is used when the thin film on the substrate is polished. As a polishing liquid, other than a polishing liquid containing ceria abrasive particles, a polishing liquid containing silica particles ($SiO_2$ particles) is effective depending on film quality of an object to be polished.

In a preferred aspect of the present invention, the polishing pad is cooled by blowing a cooling gas on the polishing pad when the thin film on the substrate is polished.

According to the present invention, by blowing a cooling gas toward the surface of the polishing pad, temperature of the polishing pad can be controlled. Therefore, as in the case where an insulating film or a metal film having a relatively large thickness on the substrate is removed, when prolonged polishing is required, the problem of the polishing performance of the ceria abrasive particles which is lowered due to temperature rise of the surface of the polishing pad and the problem of supply capacity of the polishing liquid (slurry) which is lowered with time due to a change in surface state of the polishing pad can be solved.

In a preferred aspect of the present invention, the predetermined area of the polishing pad is an area which is brought into contact with a central area of the substrate during polishing of the substrate.

According to a third aspect of the present invention, there is provided an apparatus for conditioning a polishing pad on a polishing table for polishing a thin film formed on a surface of a substrate by being brought into contact with the thin film, comprising: a dresser configured to be brought into contact with the polishing pad, the dresser being moved between a central part of the polishing pad and an outer circumferential part of the polishing pad for conditioning the polishing pad; and a controller configured to control the dresser such that a moving speed of the dresser at a predetermined area of the polishing pad is higher than a standard moving speed of the dresser at the predetermined area of the polishing pad.

In a preferred aspect of the present invention, the standard moving speed of the dresser is such a moving speed as to wear down an entire surface of the polishing pad uniformly.

According to the present invention, there is provided an apparatus for conditioning a polishing pad on a polishing table for polishing a thin film formed on a surface of a substrate by being brought into contact with the thin film, comprising: a dresser configured to be brought into contact with the polishing pad, the dresser being moved between a central part of the polishing pad and an outer circumferential part of the polishing pad for conditioning the polishing pad; and a controller configured to control the dresser such that a moving speed of the dresser at a predetermined area of the polishing pad is higher than a moving speed of the dresser at the predetermined area of the polishing pad in a standard moving recipe to increase a polishing rate of the thin film on the substrate which is polished by being brought into contact with the predetermined area of the polishing pad.

According to a fourth aspect of the present invention, there is provided an apparatus for conditioning a polishing pad on a polishing table for polishing a thin film formed on a surface of a substrate by being brought into contact with the thin film, comprising: a dresser configured to be brought into contact with the polishing pad, the dresser being moved between a central part of the polishing pad and an outer circumferential part of the polishing pad for conditioning the polishing pad; and a controller configured to control the dresser such that a moving speed of the dresser at a predetermined area of the polishing pad is lower than a standard moving speed of the dresser at the predetermined area of the polishing pad.

In a preferred aspect of the present invention, the standard moving speed of the dresser is such a moving speed as to wear down an entire surface of the polishing pad uniformly.

According to the present invention, there is provided an apparatus for conditioning a polishing pad on a polishing table for polishing a thin film formed on a surface of a substrate by being brought into contact with the thin film, comprising: a dresser configured to be brought into contact with the polishing pad, the dresser being moved between a central part of the polishing pad and an outer circumferential part of the polishing pad for conditioning the polishing pad; and a controller configured to control the dresser such that a moving speed of the dresser at a predetermined area of the polishing pad is lower than a moving speed of the dresser at the predetermined area of the polishing pad in a standard moving recipe to decrease a polishing rate of the thin film on the substrate which is polished by being brought into contact with the predetermined area of the polishing pad.

In a preferred aspect of the present invention, the moving speed of the dresser is an oscillating speed of the dresser which is oscillated about a swing shaft located outside the polishing table.

In a preferred aspect of the present invention, the polishing pad comprises a polishing pad having a number of holes in a surface thereof.

In a preferred aspect of the present invention, a polishing liquid containing ceria particles is used when the thin film on the substrate is polished.

In a preferred aspect of the present invention, the polishing pad is cooled by blowing a cooling gas on the polishing pad when the thin film on the substrate is polished.

In a preferred aspect of the present invention, the predetermined area of the polishing pad is an area which is brought into contact with a central area of the substrate during polishing of the substrate.

According to the present invention, there is provided a polishing method of polishing a thin film formed on a surface of a substrate, comprising: conditioning a polishing pad by the above conditioning method; and polishing a thin film formed on a surface of a substrate by bringing the substrate into contact with the polishing pad which has been conditioned.

According to the present invention, there is provided a polishing apparatus for polishing a thin film formed on a surface of a substrate, comprising: a polishing table having a polishing pad; a substrate holding device configured to hold a substrate and pressing the substrate against the polishing pad; and the above conditioning apparatus.

According to the present invention, a polishing rate in a central part of a surface, being polished, of a substrate such as a semiconductor wafer can be prevented from lowering, and thus the surface, being polished, of the substrate can be planarized uniformly over the entire surface of the substrate.

Further, according to the present invention, a moving speed of the dresser for dressing the polishing pad at a predetermined area of the polishing pad is made higher or conversely lower than a moving speed of the dresser at the predetermined area of the polishing pad in a standard moving recipe to increase or decrease a polishing rate of the thin film on the substrate which is polished by being brought into contact with the predetermined area of the polishing pad. Therefore, the present invention can meet the request to increase or decrease the stock removal in the predetermined area of the substrate intentionally.

DETAILED DESCRIPTION OF THE PREFERRED EMBODIMENTS

Figure 1:
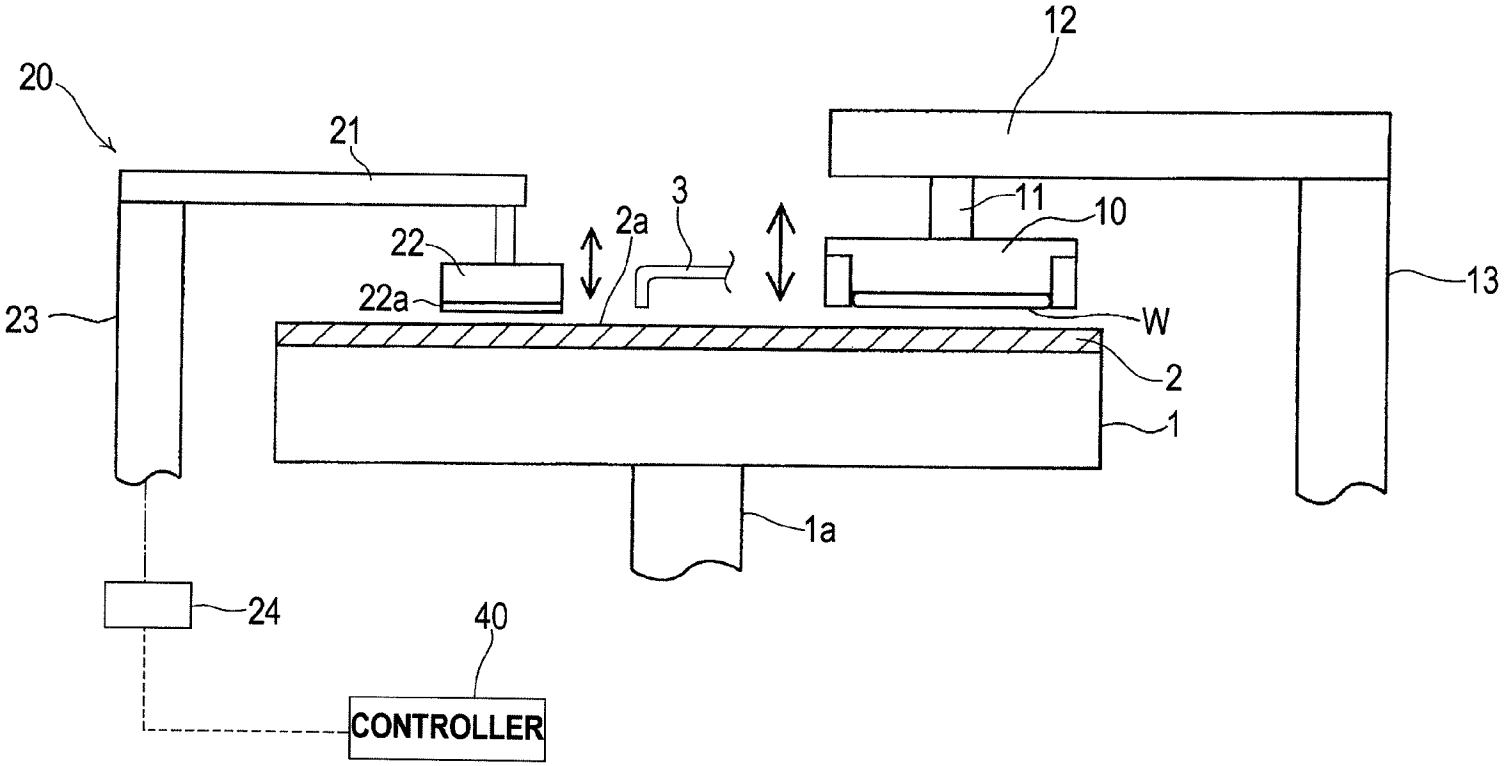
FIG. 1 is a schematic view showing an entire structure of a polishing apparatus having a conditioning apparatus of a polishing pad according to an embodiment of the present invention.

A conditioning method and apparatus of a polishing pad according to embodiments of the present invention will be described below with reference to FIGS. 1 through 4. Similar or corresponding parts are denoted by similar or corresponding reference numerals in FIGS. 1 through 4 and will not be described below repetitively.

FIG. 1 is a schematic view showing an entire structure of a polishing apparatus having a conditioning apparatus of a polishing pad according to an embodiment of the present invention. As shown in FIG. 1, the polishing apparatus comprises a polishing table 1, and a top ring 10 for holding a substrate W such as a semiconductor wafer as an object to be polished and pressing the substrate against a polishing pad 2 on the polishing table 1. The polishing table 1 is coupled via a table shaft 1*a* to a polishing table rotating motor (not shown) disposed below the polishing table 1. Thus, the polishing table 1 is rotatable about the table shaft 1*a*. A polishing pad 2 is attached to an upper surface of the polishing table 1. An upper surface of the polishing pad 2 constitutes a polishing surface 2*a* for polishing the substrate W. The polishing pad 2 comprising IC-1000/SUBA400 (two-layer cloth) manufactured by the Dow Chemical Company is used. The IC-1000 comprises a pad having a large number of fine holes formed in its surface and is also called a perforated pad. A polishing liquid supply nozzle 3 is provided above the polishing table 1 to supply a polishing liquid (slurry) onto the polishing pad 2 on the polishing table 1.

The top ring 10 is connected to a top ring shaft 11, and the top ring shaft 11 is vertically movable with respect to a top ring head 12. When the top ring shaft 11 moves vertically, the top ring 10 is lifted and lowered as a whole for positioning with respect to the top ring head 12. The top ring shaft 11 is configured to be rotated by operating a top ring rotating motor (not shown). The top ring 10 is rotated about the top ring shaft 11 by rotation of the top ring shaft 11.

The top ring 10 is configured to hold the substrate W such as a semiconductor wafer on its lower surface. The top ring head 12 is configured to be pivotable about a top ring head shaft 13. Thus, the top ring 10, which holds the substrate W on its lower surface, is movable from a position at which the top ring 10 receives the substrate to a position above the polishing table 1 by pivotable movement of the top ring head 12. Then, the top ring 10 is lowered to press the substrate W against the surface (polishing surface) of the polishing pad 2. At this time, while the polishing table 1 and the top ring 10 are respectively rotated, a polishing liquid is supplied onto the polishing pad 2 from the polishing liquid supply nozzle 3 provided above the polishing table 1. The polishing liquid containing ceria ($CeO_2$) as abrasive particles is used. In this manner, while the polishing liquid is supplied onto the polishing pad 2, the substrate W is pressed against the polishing pad 2 and is moved relative to the polishing pad 2 to polish an insulating film, a metal film or the like on the substrate. Examples of the insulating film include $SiO_2$, and examples of the metal film include a Cu film, a W film, a Ta film and a Ti film.

As shown in FIG. 1, the polishing apparatus has a conditioning apparatus 20 for conditioning (dressing) the polishing pad 2. The conditioning apparatus 20 comprises a dressing arm 21, a dresser 22 which is rotatably attached to a forward end of the dresser arm 21, a swing shaft 23 coupled to the other end of the dresser arm 21, and a motor 24 serving as a driving mechanism for oscillating (swinging) the dresser arm 21 about the swing shaft 23. The lower part of the dresser 22 comprises a dressing member 22*a*, and the dressing member 22*a* has a circular dressing surface. Hard particles are fixed to the dressing surface by electrodeposition or the like. Examples of the hard particles include diamond particles, ceramic particles and the like. A motor (not shown) is provided in the dresser arm 21, and the dresser 22 is rotated by the motor. The swing shaft 23 is coupled to a lifting and lowering mechanism (not shown), and the dresser arm 21 is lowered by the lifting and lowering mechanism to allow the dressing member 22*a* to be pressed against the polishing surface 2*a* of the polishing pad 2. Equipment including the polishing table 1, the top ring 10, the conditioning apparatus 20 and the like are connected to a controller 40, and the rotational speed of the polishing table 1, the rotational speed and the polishing pressure of the top ring 10, the oscillating speed of the dresser 22 in the conditioning apparatus 20, and the like are controlled by the controller 40.

Figure 2:
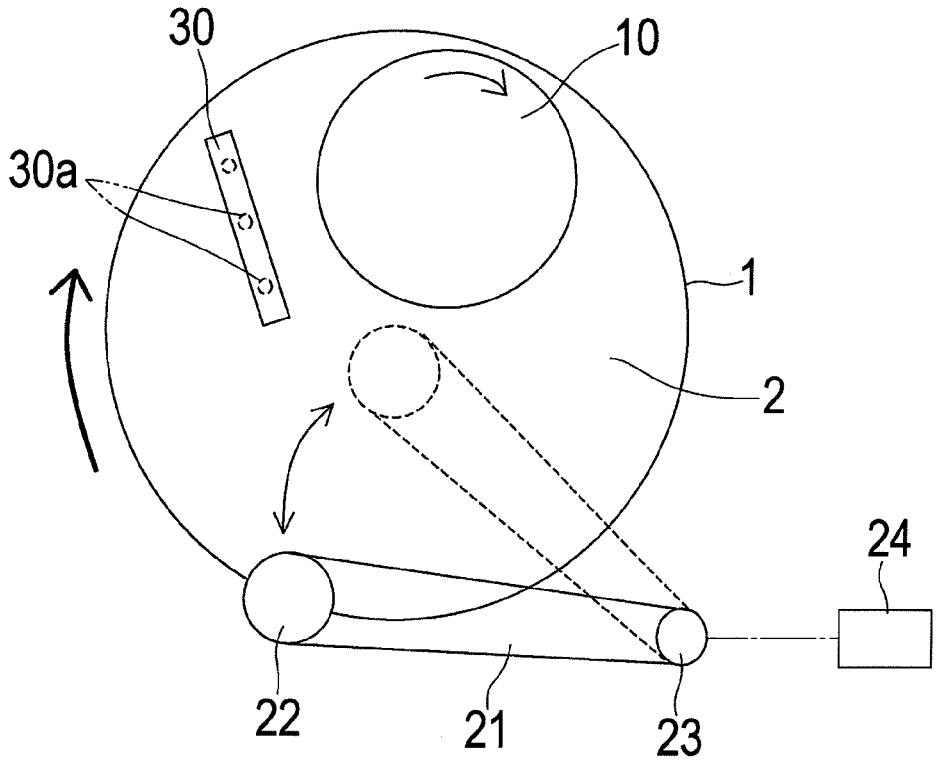
FIG. 2 is a plan view showing a top ring positioned on a polishing table and a moving locus of a dresser when the dresser dresses the surface (polishing surface) of the polishing pad.

FIG. 2 is a plan view showing the top ring 10 positioned on the polishing table 1 and a moving locus of the dresser 22 when the dresser 22 dresses the surface (polishing surface) of the polishing pad 2. As shown in FIG. 2, the dresser arm 21 is longer than a radius of the polishing pad 2, and the swing shaft 23 is positioned radially outwardly of the polishing pad 2. When the polishing surface of the polishing pad 2 is dressed, the polishing pad 2 is rotated and the dresser 22 is rotated by the motor, and then the dresser arm 21 is lowered by the lifting and lowering mechanism to bring the dressing member 22*a* provided at the lower surface of the dresser 22 into sliding contact with the polishing surface of the rotating polishing pad 2. In this state, the dresser arm 21 is oscillated (swung) about the swing shaft 23 by the motor 24. During dressing of the polishing pad 2, pure water (deionized water) as a dressing liquid is supplied onto the polishing surface of the polishing pad 2 from the polishing liquid supply nozzle 3 (see FIG. 1). By swing motion of the dresser arm 21, the dresser 22 located at the forward end of the dresser arm 21 can move transversely from the outer circumferential end to the central part of the polishing surface of the polishing pad 2. By this swing motion, the dressing member 22*a* can dress the polishing surface of the polishing pad 2 over the entire surface including the central part.

Further, as shown in FIG. 2, the polishing apparatus has a cooling nozzle 30 serving as a gas ejection unit which is installed parallel to the polishing surface of the polishing pad 2 and extends along the substantially radial direction of the polishing pad 2. Gas ejection ports 30*a* communicating with the interior of the cooling nozzle 30 are provided at the lower part of the cooling nozzle 30 to eject a cooling gas such as compressed air toward the polishing pad 2. The location of the cooling nozzle 30 and the number of gas ejection ports 30*a* provided in the cooling nozzle 30 are set arbitrarily in accordance with the process condition or the like.

Figure 3:
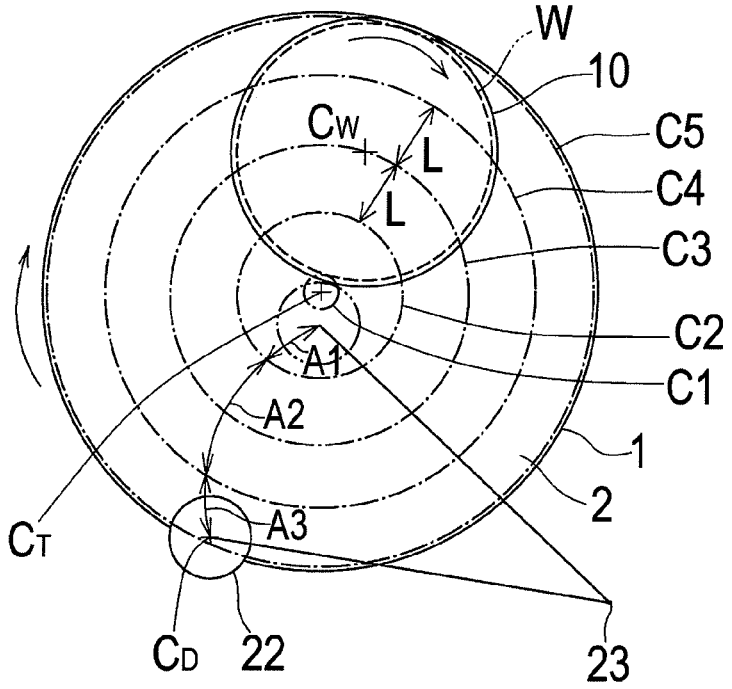
FIG. 3 is a plan view showing the relationship between the polishing pad on the polishing table, the top ring holding the substrate, and the dresser and showing areas on the polishing pad.

FIG. 3 is a plan view showing the relationship between the polishing pad 2 on the polishing table 1, the top ring 10 holding the substrate W, and the dresser 22. In FIG. 3, the symbol $C_T$ represents a rotation center of the polishing table 1, and the symbol $C_W$ represents a center of the substrate W held on the lower surface of the top ring 10. Further, the symbol $C_D$ represents a center of the dresser 22. During polishing, the polishing table 1 rotates in a clockwise direction about the rotation center $C_T$, and the top ring 10 rotates in a clockwise direction about the center $C_W$. During polishing, the top ring 10 is not moved in the horizontal direction, and thus the substrate W held by the top ring 10 remains at the position shown in FIG. 3. Concentric circles C1, C2, C3, C4 and C5 described about the center $C_T$ on the polishing pad 2 represent loci in the case where the polishing pad 2 passes through predetermined positions on the surface, being polished, of the substrate W by the rotation of the polishing table 1. Specifically, the concentric circle C3 on the polishing pad 2 passes through the center $C_W$ of the substrate W, and the concentric circle C2 on the polishing pad 2 passes through a central area of the substrate W spaced by a distance L from the center $C_W$ of the substrate W to a radially inner side of the polishing table, and the concentric circle C4 on the polishing pad 2 passes through a central area of the substrate W spaced by a distance L from the center $C_W$ of the substrate W to a radially outer side of the polishing table. Further, the concentric circle C1 on the polishing pad 2 passes through the neighborhood of the outer circumferential edge of the substrate W in the vicinity of the rotation center $C_T$ of the polishing table 1, and the concentric circle C5 on the polishing pad 2 passes through the neighborhood of the outer circumferential edge of the substrate W in the vicinity of the outer circumferential edge of the polishing table 1. If the diameter of the substrate W is 300 mm, the distance L is about 20 to 140 mm.

On the other hand, the dresser 22 is swung about the swing shaft 23 on the polishing pad 2, and thus the dresser 22 is radially reciprocated between the central part of the polishing pad 2 and the outer circumferential edge of the polishing pad 2. The outer diameter of the dresser 22 is set to be smaller than the diameter of the substrate W to be polished. Specifically, in the case where the diameter of the dresser 22 is d and the diameter of the substrate W to be polished is D, d is set in the range of (1/15) D to 1D, i.e., d=(1/15) D to 1D. Then, the oscillating speed (swing speed) of the dresser 22 can be adjusted in each of the areas on the polishing pad 2 when the dresser 22 is oscillated between the outer circumferential edge of the polishing pad 2 and the central part of the polishing pad 2. Specifically, when the dresser 22 is swung from the center of the polishing pad 2 toward the outer circumferential edge of the polishing pad 2, the oscillating speed of the dresser 22 is set such that the oscillating speed is low at the area A1 from the concentric circle C1 to the concentric circle C2, high at the area A2 from the concentric circle C2 to the concentric circle C4, and low at the area A3 from the concentric circle C4 to the concentric circle C5. Conversely, when the dresser 22 is swung from the outer circumferential edge of the polishing pad 2 toward the center of the polishing pad 2, the oscillating speed of the dresser 22 is set such that the oscillating speed is low at the area A3 from the concentric circle C5 to the concentric circle C4, high at the area A2 from the concentric circle C4 to the concentric circle C2, and low at the area A1 from the concentric circle C2 to the concentric circle C1. In this manner, the oscillating speed of the dresser 22 is changed in each of the areas, and this change of the oscillating speed is performed by setting an oscillating recipe in the controller 40, and the conditioning apparatus 20 is controlled on the basis of the oscillating recipe by the controller 40. The controller 40 may be installed in the conditioning apparatus 20. In each of the cases where the dresser 22 is moved from the center of the polishing pad 2 toward the outer circumferential edge of the polishing pad 2 one time, the dresser 22 is moved from the outer circumferential edge of the polishing pad 2 toward the center of the polishing pad 2 one time, the dresser 22 is oscillated between the center of the polishing pad 2 and the circumferential edge of the polishing pad 2 one time, and the dresser 22 is oscillated between the center of the polishing pad 2 and the outer circumferential edge of the polishing pad 2 several times, the moving speed or the oscillating speed of the dresser 22 is controlled in each of the areas in the same manner as the above.

As shown in FIG. 3, the area A1 from the concentric circle C1 to the concentric circle C2 in the polishing pad 2 is brought into contact with the outer circumferential area (edge area) of the substrate W, the area A2 from the concentric circle C2 to the concentric circle C4 in the polishing pad 2 is brought into contact with the central area (center area) of the substrate W, and the area A3 from the concentric circle C4 to the concentric circle C5 in the polishing pad 2 is brought into contact with the outer circumferential area (edge area) of the substrate W. The pad scratching distance by the dresser is small in the area A2 where the oscillating speed of the dresser is high, and the pad scratching distance by the dresser is large in the areas A1 and A3 where the oscillating speed of the dresser is low. Thus, the amount of slurry remaining in the area A2 on the polishing pad 2 becomes large, and the amount of slurry remaining in the areas A1 and A3 becomes small. Therefore, during polishing, the central area of the substrate W is brought into sliding contact with the area A2 where the amount of residual slurry is large on the polishing pad 2, and the outer circumferential area of the substrate W is brought into sliding contact with the areas A1 and A3 where the amount of residual slurry is small on the polishing pad 2. In this manner, in the case where the substrate W is polished by the polishing pad 2 where there is a difference in the amount of slurry remaining in each of the areas, the polishing rate is prevented from lowering in the center area where the amount of residual slurry is large, thus improving in-plane uniformity of the polishing rate. In this case, making the oscillating speed of the dresser 22 high or making the oscillating speed of the dresser 22 low means that while the oscillating speed of the conventional dresser in each of the areas is set to a standard oscillating recipe in which the entire surface of the polishing pad is uniformly worn down, the oscillating speed of the dresser 22 is made higher or lower than the conventional oscillating speed in the same area (same section).

Although the case where the polishing pad 2 is divided into three dressing areas and the oscillating speed of the dresser 22 is changed in each of the areas has been described, the polishing pad 2 may be divided further into six dressing areas, twelve dressing areas or the like, and the oscillating speed of the dresser 22 may be changed in each of the areas.

Figure 4A:
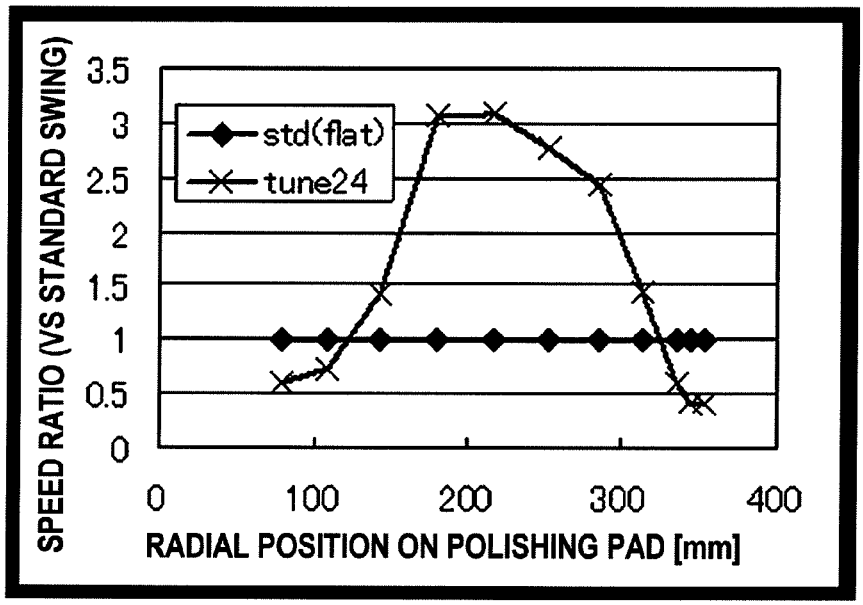
FIGS. 4A and 4B are graphs showing experimental results obtained by conditioning the polishing pad in such a manner that the oscillating speed of the dresser is changed in each of the areas and by polishing substrates using the polishing pad which has been conditioned with the changed oscillating speed.
Figure 4B:
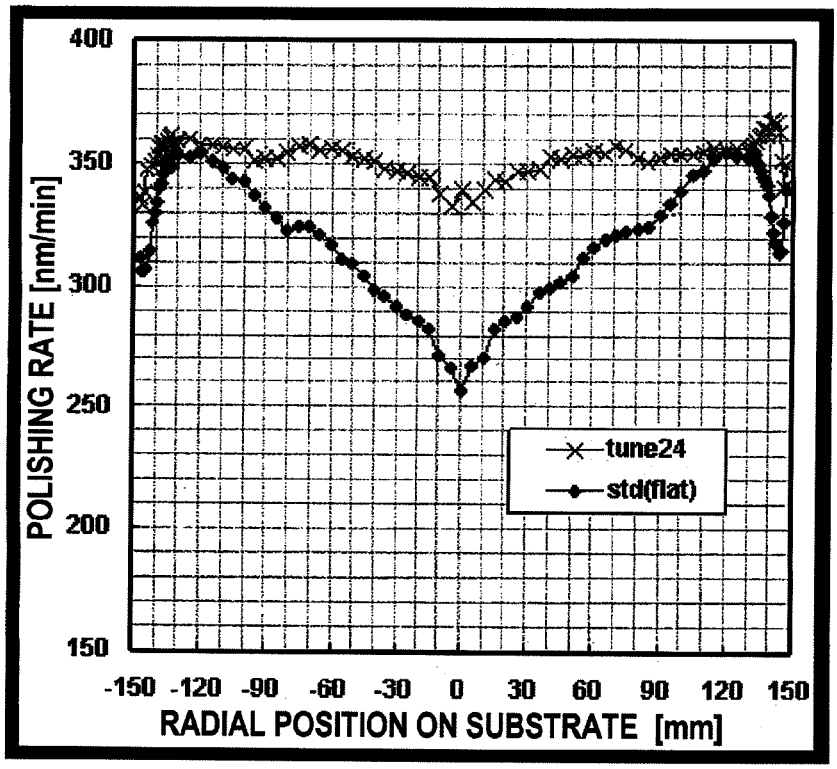

Next, experimental results obtained by conditioning the polishing pad in such a manner that the oscillating speed of the dresser 22 is changed in each of the areas and by polishing substrates using the polishing pad which has been conditioned with the changed oscillating speed will be described with reference to FIGS. 4A and 4B. FIG. 4A is a graph showing the relationship between the radial position on the polishing pad and the oscillating speed ratio of the dresser. FIG. 4B is a graph showing the relationship between the radial position on the substrate and the polishing rate when the substrates are polished by the polishing pad which has been conditioned using the oscillating speed of the dresser shown in FIG. 4A. The substrates having a diameter of 300 mm were used. Further, during polishing of the substrates using the polishing pad which has been conditioned, a cooling gas is blown from the cooling nozzle 30 to the polishing pad to cool the polishing surface of the polishing pad 2.

In FIG. 4A, the straight line (std) represented by black rhombuses represents the recipe (standard moving recipe) in which the oscillating speed of the dresser in each of the areas is adjusted to obtain the identical cutting rate (wear rate) over the entire surface of the polishing pad, and this case is referred to as standard oscillation. In FIG. 4A, the horizontal axis represents radial position on the polishing pad, and the vertical axis represents the speed ratio to the standard oscillating speed in each of the areas in this recipe. Therefore, the speed ratio of the standard oscillation becomes 1 over the entire area of the polishing pad. The curve (tune 24) represented by "X" marks represents the case where the speed ratio is increased from the position of about 80 mm to the position of about 180 mm from the center of the polishing pad in a radial direction of the polishing pad, and is decreased from the position of about 220 mm to the position of about 350 mm from the center of the polishing pad in the radial direction of the polishing pad. The speed ratio to the standard oscillation increases gradually from 0.6 (position of about 80 mm) to 3.1 (position of about 180 mm) and decreases gradually from 3.1 (the position of about 220 mm) to 0.4 (position of about 350 mm).

Here, the standard oscillating speed in the radial position of about 80 mm is 11 mm/sec, the standard oscillating speed in the radial position of about 180 mm is 21 mm/sec, the standard oscillating speed in the radial position of about 220 mm is 21 mm/sec, and the standard oscillating speed in the radial position of about 350 mm is 13 mm/sec.

In FIG. 4A, the oscillating speed pattern shown by "std" represents the standard oscillation in which the oscillating speed of the dresser in each of the areas is adjusted to obtain the identical cutting rate (wear rate) over the entire surface of the polishing pad. This conditioning method is the same as the conventional conditioning method. In the oscillating speed pattern shown by "tune 24", the oscillating speed of the dresser is low in the central part (area A1 of FIG. 3) and the outer circumferential part (area A3 of FIG. 3), and the oscillating speed of the dresser is high in the intermediate part (area A2 of FIG. 3) between the central part of the polishing pad and the outer circumferential part of the polishing pad. This conditioning method is the same as the conditioning method shown in FIG. 3. Other dressing conditions such as the rotational speed of the dresser are the same in both of "std" and "tune 24."

In FIG. 4B, the polishing rate (std) represented by black rhombuses is low at the central area of the substrate and is high at the outer circumferential area of the substrate. Therefore, it is understood that in the case where the polishing pad conditioned by the standard oscillating recipe was used, the central area of the substrate was polished insufficiently. The polishing rate (tune 24) represented by the "X" marks is substantially uniform over the entire surface of the substrate with no difference in the central area and the outer circumferential area of the substrate. Thus, it is understood that in the case where the polishing pad conditioned by the recipe in which the oscillating speed of the dresser in the area A2 of the polishing pad is higher than that in the standard oscillating recipe was used, the substrate was uniformly polished over the entire surface of the substrate. Other polishing conditions such as the rotational speed of the polishing table, the rotational speed of the top ring, the polishing pressure and the like are the same in both of "std" and "tune 24."

From the above experimental results, the following has been confirmed: In the case where the polishing pad conditioned by the recipe in which the oscillating speed of the dresser in the area A2 of the polishing pad is higher than that in the standard oscillating recipe is used, the amount of slurry remaining on the polishing pad 2 is large at the central area of the substrate and is small at the outer circumferential area of the substrate. Thus, when the substrate is polished by the polishing pad having different amounts of residual slurry in each of the areas, the polishing rate is prevented from lowering in the central area where the amount of residual slurry is large, thus improving in-plane uniformity of the polishing rate.

Although the case where the dresser 22 is swung has been described in the embodiments shown in FIGS. 1 through 4, the dresser 22 may be moved linearly in the radial direction of the polishing pad 2. Further, the case where the oscillating speed of the dresser 22 is changed in each of the areas of the polishing pad 2 has been described. However, the amount of residual slurry may differ in each of the areas of the polishing pad 2 by changing the dressing load, the rotational speed of the dresser, the dressing time, the rotational speed of the polishing table, and the like. Further, although the case where the perforated pad is used as a polishing pad has been described, a grooved pad having grooves formed in a surface of the pad may be used.

By using the above-described conditioning method and apparatus of the polishing pad, the polishing apparatus can planarize a surface, being polished, of a substrate such as a semiconductor wafer over the entire surface of the substrate.

Although the embodiments of the present invention have been described herein, the present invention is not intended to be limited to these embodiments. Therefore, it should be noted that the present invention may be applied to other various embodiments within a scope of the technical concept of the present invention.

What is claimed is:

1. A method of conditioning a polishing pad on a polishing table for polishing a thin film formed on a surface of a substrate, the polishing pad to be brought into contact with the thin film to perform the polishing, said method comprising:

bringing a dresser into contact with the polishing pad, the dresser being capable of wearing down an entire surface of the polishing pad uniformly when the dresser is moved at an identified standard moving speed, the standard moving speed being defined as a moving speed of the dresser preset at each of a plurality of areas identified in a radial direction of the polishing pad to obtain the identical wear rate over the entire surface of the polishing pad; and conditioning the polishing pad by moving the dresser between a central part of the polishing pad and an outer circumferential part of the polishing pad;

wherein a moving speed of the dresser at a predetermined area of the polishing pad is lower than the standard moving speed of the dresser preset for the predetermined area of the polishing pad; and wherein the predetermined area of the polishing pad is defined as the area of the polishing pad to be brought into contact with a portion of the surface of the substrate whereat a polishing rate will be higher than a polishing rate of any other portion of the surface of the substrate if the predetermined area of the polishing pad was conditioned by moving the dresser at the standard moving speed.

2. The method of conditioning a polishing pad according to claim 1, wherein said moving speed of the dresser is an oscillating speed of the dresser which is oscillated about a swing shaft located outside the polishing table.

3. The method of conditioning a polishing pad according to claim 1, wherein the polishing pad comprises a polishing pad having a plurality of holes in a surface thereof.

4. The method of conditioning a polishing pad according to claim 1, further comprising polishing the thin film on the substrate using a polishing liquid containing ceria particles.

5. The method of conditioning a polishing pad according to claim 1, further comprising polishing the thin film on the substrate and cooling the polishing pad by blowing a cooling gas on the polishing pad when the thin film on the substrate is polished.

6. The method of conditioning a polishing pad according to claim 1, wherein the predetermined area of the polishing pad is an area which is to be brought into contact with a central area of the substrate during polishing of the substrate.

7. An apparatus for conditioning a polishing pad on a polishing table for polishing a thin film formed on a surface of a substrate, the polishing pad to be brought into contact with the thin film to perform the polishing, said apparatus comprising:

a dresser configured to be brought into contact with the polishing pad, said dresser to be moved between a central part of the polishing pad and an outer circumferential part of the polishing pad for conditioning the polishing pad, the dresser being configured to wear down an entire surface of the polishing pad uniformly when the dresser is moved at an identified standard moving speed, the standard moving speed being defined as a moving speed of the dresser preset at each of a plurality of areas identified in a radial direction of the polishing pad to obtain the identical wear rate over the entire surface of the polishing pad; and a controller configured to control said dresser such that a moving speed of said dresser at a predetermined area of the polishing pad is lower than the standard moving speed of said dresser preset for the predetermined area of the polishing pad;

wherein the predetermined area of the polishing pad is defined as the area of the polishing pad to be brought into contact with a portion of the surface of the substrate whereat a polishing rate will be higher than a polishing rate of any other portion of the surface of the substrate if the predetermined area of the polishing pad was conditioned by moving the dresser at the standard moving speed.

8. The apparatus for conditioning a polishing pad according to claim 7, wherein the moving speed of said dresser is an oscillating speed of said dresser which is oscillated about a swing shaft located outside of said polishing table.

9. The apparatus for conditioning a polishing pad according to claim 7, wherein the polishing pad comprises a polishing pad having a plurality of holes in a surface thereof.

10. The apparatus for conditioning a polishing pad according to claim 7, further comprising a polishing liquid containing ceria particles to be used when the thin film on the substrate is polished.

11. The apparatus for conditioning a polishing pad according to claim 7, further comprising a cooling nozzle for cooling the polishing pad by blowing a cooling gas on the polishing pad when the thin film on the substrate is polished.

12. The apparatus for conditioning a polishing pad according to claim 7, wherein said predetermined area of said polishing pad is an area which is to be brought into contact with a central area of the substrate during polishing of the substrate.

* * * * *